US010501957B1

(12) United States Patent
Borowiak

(10) Patent No.: US 10,501,957 B1
(45) Date of Patent: Dec. 10, 2019

(54) UNDERGROUND POST MOUNTING APPARATUS

(71) Applicant: Jeffery A. Borowiak, Gaylord, MI (US)

(72) Inventor: Jeffery A. Borowiak, Gaylord, MI (US)

( * ) Notice: Subject to any disclaimer, the term of this patent is extended or adjusted under 35 U.S.C. 154(b) by 3 days.

(21) Appl. No.: 16/048,557

(22) Filed: Jul. 30, 2018

(51) Int. Cl.

| | |
|---|---|
| ***E04H 12/22*** | (2006.01) |
| ***E02D 27/42*** | (2006.01) |
| ***E01F 9/677*** | (2016.01) |
| ***E04H 17/22*** | (2006.01) |
| ***E01F 9/685*** | (2016.01) |
| ***E04H 12/34*** | (2006.01) |

(52) U.S. Cl.
CPC ..... *E04H 12/2253* (2013.01); *E01F 9/677* (2016.02); *E01F 9/685* (2016.02); *E02D 27/42* (2013.01); *E04H 12/22* (2013.01); *E04H 12/2269* (2013.01); *E04H 12/34* (2013.01); *E04H 17/22* (2013.01); *E02D 2200/1628* (2013.01); *E02D 2600/20* (2013.01)

(58) Field of Classification Search
CPC ..... E04H 12/22; E04H 17/22; E04H 12/2269; E04H 12/2253; E04H 12/34; E01F 9/685; E01F 9/677; E02D 27/42; E02D 2600/20
See application file for complete search history.

(56) References Cited

U.S. PATENT DOCUMENTS

| | | | | |
|---|---|---|---|---|
| 3,603,547 | A | 9/1971 | Hills | |
| 3,762,674 | A | 10/1973 | Ortega | |
| 4,236,665 | A | 12/1980 | Glass | |
| 5,022,618 | A | 6/1991 | Barrett et al. | |
| 5,058,337 | A | 10/1991 | O'Connor | |
| 5,082,231 | A | 1/1992 | Knowles | |
| 5,901,525 | A * | 5/1999 | Doeringer | E04H 12/2253 248/519 |
| 5,984,587 | A | 11/1999 | Odle | |
| 7,497,368 | B2 | 3/2009 | Lutzke | |
| 7,549,259 | B2 | 6/2009 | Calle | |
| 2008/0222976 | A1 * | 9/2008 | Liskey | E02D 27/12 52/169.9 |

(Continued)

FOREIGN PATENT DOCUMENTS

| | | |
|---|---|---|
| JP | 9-224810 A | 9/1997 |

OTHER PUBLICATIONS

Salsbury Industries; Classic Mailbox Posts—4890 Series; mailbox installation instructions; Jul. 23, 2013; 6 pages; Salsbury Industries; U.S.

*Primary Examiner* — Jessie T Fonseca
(74) *Attorney, Agent, or Firm* — Northern Michigan Patent Law, PLC

(57) ABSTRACT

A post mounting apparatus for removably securing the lower end of a post in the ground. The post mounting apparatus comprises a base plate with an upwardly facing socket sized to receive the lower end of the post, the base plate and socket being buried in the ground with an upper end of the socket exposed above ground to receive the post. A cross-piece traversing the interior of the socket and spaced above the lower end of the socket supports the bottom of the post above the bottom of the socket. Internal vertical splines formed on the socket inner wall above the cross-piece engage the lower portion of the post with a snug but easily-removable fit.

12 Claims, 5 Drawing Sheets

(56) References Cited

U.S. PATENT DOCUMENTS

| | | | | |
|---|---|---|---|---|
| 2011/0163213 | A1* | 7/2011 | Borowiak | A47G 29/1216 248/219.2 |
| 2011/0214363 | A1* | 9/2011 | Day | E02D 19/00 52/169.5 |
| 2014/0059957 | A1* | 3/2014 | Stark | E02D 27/42 52/292 |
| 2014/0077046 | A1 | 3/2014 | Borowiak | |
| 2014/0102025 | A1* | 4/2014 | Cariaga | E02D 27/42 52/299 |
| 2014/0373461 | A1* | 12/2014 | Rodriguez | E04H 12/2292 52/170 |
| 2015/0225919 | A1* | 8/2015 | Wagler | E02D 27/42 52/166 |
| 2015/0308140 | A1* | 10/2015 | Clifton | F03D 9/007 248/346.2 |
| 2016/0230365 | A1* | 8/2016 | Shi | E02D 27/42 |
| 2017/0030045 | A1* | 2/2017 | Krause | E02D 27/425 |
| 2018/0230664 | A1* | 8/2018 | Dominguez | E04H 12/2269 |

* cited by examiner

UNDERGROUND POST MOUNTING APPARATUS

RELATED APPLICATIONS/PRIORITY BENEFIT CLAIM

Not applicable

FIELD

The subject matter of the present application is in the field of apparatus for temporarily securing the lower end of a post in the ground.

BACKGROUND

Elongated wooden posts are commonly buried partway in the ground to provide support for various structures (small building frames, mailboxes, fences, bird feeders, clotheslines, etc.). It is known to add structure to the lower end of the post, engaging the ground or buried in the ground, for greater stability.

U.S. Patent Application No. US 2015/0225919 A1 to Wagler discloses a footing assembly for a vertical post in post-frame building construction, the footing assembly comprising a post rail assembly slidably disposed within an elongated bridge member.

U.S. Pat. No. 5,984,587 to Odle discloses a ground stabilizing apparatus for fence posts and the like, comprising a central ground support collar to which a plurality of radially extending stabilization arms are attached, distributing force on the post to a large area near the surface of the ground around the post.

U.S. Pat. No. 3,762,674 to Ortega discloses a signpost base receptacle for releasably mounting a signpost in a concrete pad, the receptable being substantially larger than the base of the signpost and recessed in a concrete pad with its top substantially flush with ground level. A rotatable shaft with eccentric cams engage a movable clamping plate to selectively engage the base of a signpost placed in the receptacle.

U.S. Pat. No. 3,603,547 to Hills discloses angle adjustable post support tubes pivotally attached to a base plate that can be buried in the ground, especially for supporting the angled post legs of an outdoor playground swing set.

U.S. Pat. No. 7,549,259 to Calle a footing device for a structure, the footing including a reinforcing member with a base plate extending in a first direction and a leg extending in a second direction, with a sleeve defining a cavity for receiving the leg, a portion of a fence post, and an anchoring material for securing the leg to the structure.

U.S. Pat. No. 4,236,665 to Glass discloses a bracket for mounting a mailbox, with a pair of substantially identical upper and lower plate members each having surrounding walls and a plurality of open housings or sockets projecting from the plates and interconnected by reinforcing ribs. The sockets have interior vertical splines, and elongated posts are engaged in aligned pairs of the housings and frictionally locked thereto by the splines. The lower plate member is embedded in the earth along with portions of the posts, and a mailbox is secured to the exposed upper plate member.

U.S. Patent Application Publication No. US 2014/0077046 A1 to Borowiak discloses a mailbox mounting system for mounting a mailbox to an upstanding post. The system includes a plate with a sleeve extending downwardly from the lower surface of the plate, the sleeved adapted to matingly receive the upper portion of the post. Interior ribs in the sleeve fittingly secure the post within the sleeve to mount the plate on the post. The upper surface of the plate supports the lower surface of the mailbox. Elongated support brackets are provided to mount multiple mailboxes transversely to the long axis of the plate. The manner of mounting the lower end of the post in the ground is not addressed in this application.

The prior art devices above lack the combination of simplicity, ease of installation, and ease of removing and replacing a post from the buried stabilizing structure that would make them truly convenient for home owners when mounting posts in their yards.

BRIEF SUMMARY

The present invention is a post mounting apparatus comprising a base plate with an upward-facing socket having a perimeter wall defining a sleeve configured to receive the lower end of a post. A cross-piece extends across the interior of the socket at a height between the upper and lower ends of the socket, positioned to support the lower end of the post so that it is spaced above the bottom of the socket.

The socket may include a plurality of internal vertical splines along the inner side or sides of the wall (depending on the wall's shape) adapted to frictionally engage or bite into the outer surface of the lower end of the post. The splines extend above the cross-piece, and only portions of the splines above the cross-piece engage the post when the post is inserted sufficiently to rest on the cross-piece.

In another aspect of the invention, a sleeve extension is configured to mate over the exterior of the socket wall, with apertures in a lower end of the sleeve extension positioned to admit the cross-piece therethrough to lock the sleeve extension to the socket. The sleeve extension allows the base plate assembly to be buried deeper than the height of the socket, so that the post can be easily inserted and removed from the buried base plate assembly without the hole caving-in or the socket filling with dirt.

In a further aspect, the base plate includes a pair of transverse stabilizer legs mounted along the outer ends of the base plate, the stabilizer legs extending beyond the outer ends and the adjacent sides of the base plate on opposite sides of the plate.

The invention further comprises the assembled combination of the base plate and a post, wherein the base plate is buried in the ground, with the socket facing upwardly and with a portion of the socket wall at or above the surface of the ground, and with the post inserted in the socket to rest on the cross-piece spaced above the bottom of the socket. The assembled combination may include the sleeve extension for deeper burial and/or more sleeve height above the surface of the ground, and the transverse stabilizer legs pre-attached to the base plate and buried with the base plate for increased stability.

Terms of orientation such as "vertical", "horizontal" and "perpendicular" should be understood in a general rather than an absolute sense, encompassing reasonable variations during manufacture, or during assembly and installation by persons of varying skill.

These and other features and advantages of the invention will become apparent from the detailed description below, in light of the accompanying drawings.

DETAILED DESCRIPTION

Figure 1:
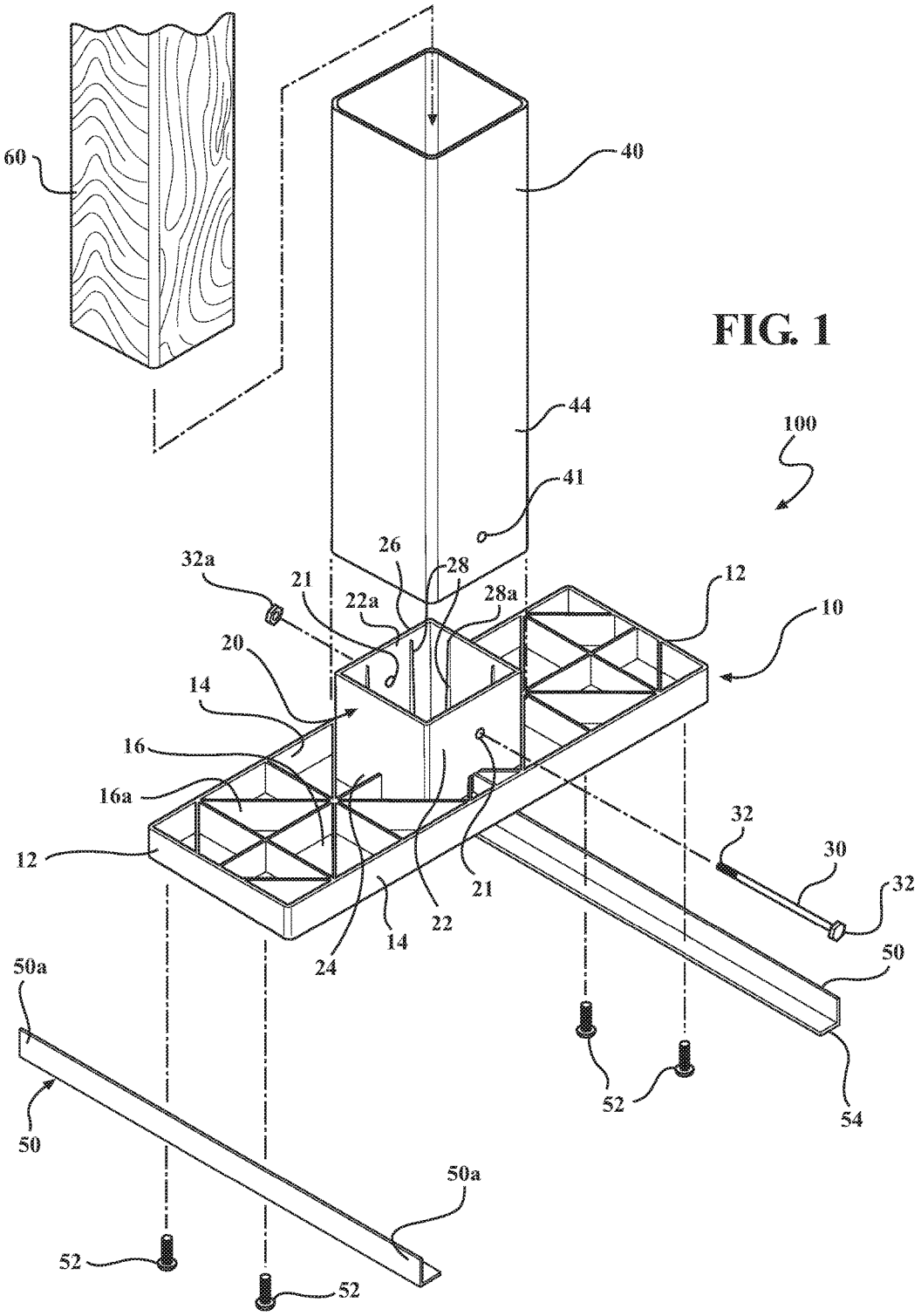
FIG. 1 is a perspective exploded view of an example post-mounting apparatus according to the invention, and a mating post, prior to burial.
Figure 2:
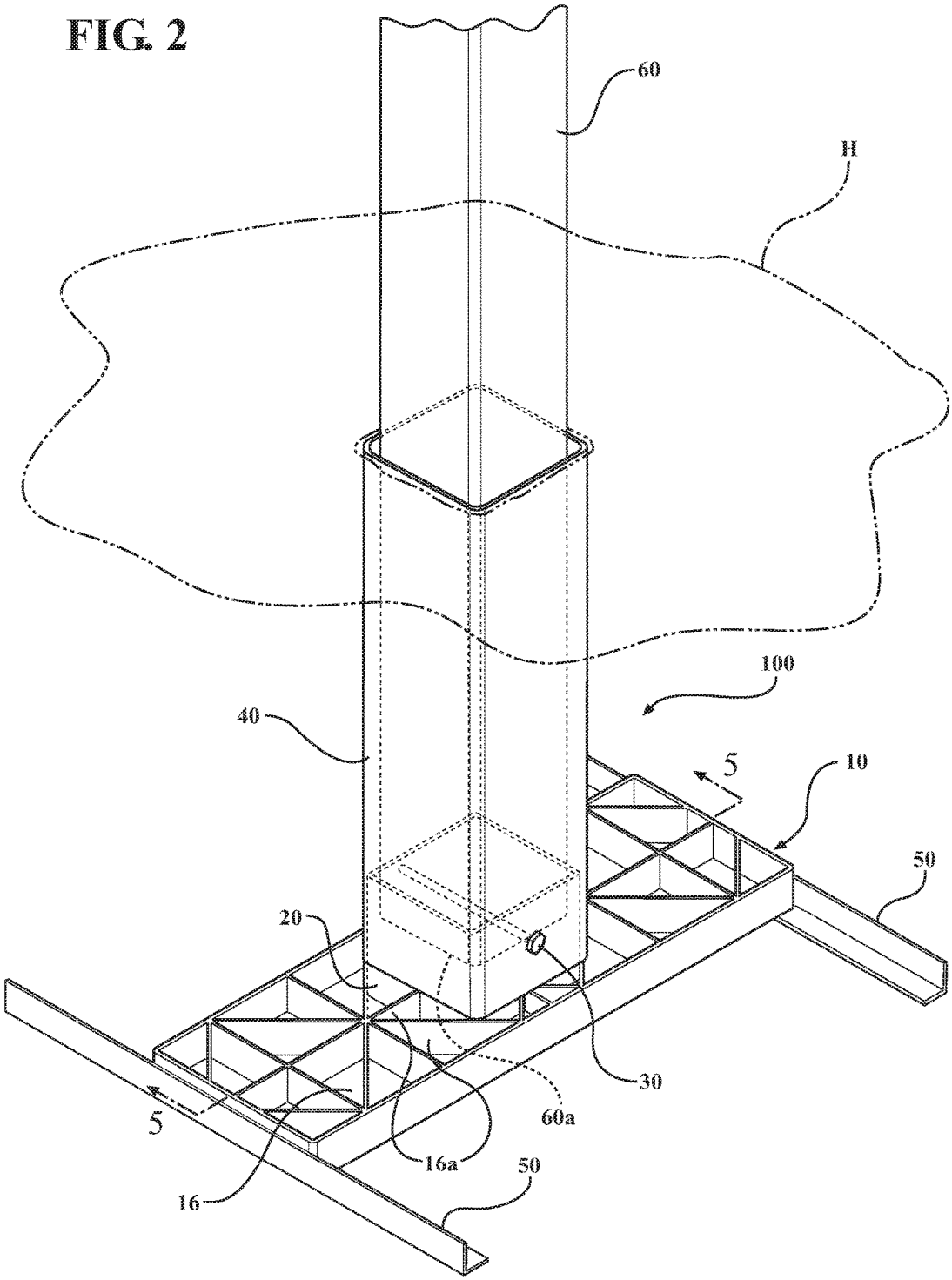
FIG. 2 is a perspective view of the post-mounting apparatus and post of FIG. 1, assembled and prior to burial.

Referring first to FIGS. 1 and 2, a post mounting apparatus 100 is shown in exemplary form in order to teach how to make and use the claimed invention. Apparatus 100 comprises a base plate 10, in the illustrated example molded from a durable plastic material and having a rectangular shape with ends 12 and sides 14. It will be understood that the shape of the base plate may vary, although a rectangular plate with longer sides 14 and shorter perpendicular ends 12 is preferred. It will also be understood that the material used for base plate 10 may vary, for example it may be made from metal rather than a polymer material.

Base plate 10 has an upper face 16, in the illustrated example reinforced with a pattern of upstanding ribs or flanges 16*a* which also serve to increase the effective soil-engaging surface area of the upper face. Upper face 16 includes a single central socket 20 configured to matingly receive a similarly-shaped lower end of a common type of post 60, by way of non-limiting example a 4"×4" rot-resistant or treated wooden post of the type commonly used for fence posts, mailbox posts, and other lawn, garden, playground, and outdoor structure applications. While a square socket 20 is illustrated, it is possible to shape the socket differently for differently shaped posts.

Socket 20 is shown molded integrally with base plate 10, although it could be formed separately and subsequently attached to the base plate. Socket 20 has an upstanding or vertical perimeter wall 22 of a height sufficient to receive a desired length of the lower end of post 60 into the socket for stability, for example 4"-12" (inches) or so. The inner surface 22*a* of wall 22 is preferably fairly smooth. The lower end 24 of the socket may coincide with and be closed by the upper face 16 of the base plate, while the upper end 26 of the socket 20 is open to receive the post.

Socket 20 preferably includes an array of vertical post-engaging splines 28 spaced along the inner surface 22*a* of wall 22. Splines 28 are narrow and preferably angled or pointed at their upper ends 28*a* to frictionally engage and/or bite into the end and side surfaces of post 60 as the post is inserted into the socket. The thickness of the splines and the extent to which the splines engage or penetrate the surfaces of the post upon insertion (i.e., the splines' width as measured from the inner wall toward the center of the socket) may vary, depending on how tight a frictional fit between the post and socket is desired and the dimensions of the lower end of the post. In the illustrated example, splines 28 have a height essentially the same as the socket 22, i.e. extending essentially the full height of wall 22. Alternately, the splines may be shorter than the height of socket 20, so that the splines only extend partway down the socket inner wall 22*a* from the upper end 26 with most or all of their length located above the cross-piece.

Socket 20 further includes a pair of opposing, aligned apertures 21 formed in opposite sides of wall 22 to admit a cross-piece 30, such as (but not limited to) a strong metal or plastic pin or bolt. Where a single cross-piece 30 is used as shown, the cross-piece should be centered in the socket 20. If multiple-cross-pieces are used, they are preferably evenly spaced relative to each other and to the socket 20. The cross-piece 30 is sufficiently long that its ends 32 extend to opposing sides of wall 22 to be firmly secured in or to the wall, for example with ends 32 extending through apertures 21 in wall 22 to the outside of socket 20 where they can be locked in place with an external locking member 32*a* such as a threaded nut or a cotter pin. Cross-piece 30 is also significantly less wide than the width of socket 20, so that air space remains on either side of the cross-piece in the socket adjacent the bottom of the post.

The illustrated apparatus 100 further includes an optional sleeve extension 40 configured to fit closely over socket 20 (and post 60) to extend the effective height of wall 22 relative to the base plate, and to allow deeper burial. Alternately, socket 20 could be made with integral wall 22 having a greater height to allow deeper burial without the need for an extension sleeve. If, however, a sleeve extension 40 is used, the lower end 44 of the extension includes a pair of opposingly aligned apertures 41 matching the position and alignment of apertures 21 in socket 20 when the sleeve extension 40 is assembled over the socket. Cross-piece 30 accordingly can extend through the walls of both socket 20 and sleeve extension 40 to lock them together prior to burial. Sleeve 40 engages and overlies most of the upper part of socket wall 22 on socket 20, but the lowermost end of sleeve 40 remains spaced above upper surface 16 of base plate 12 by virtue of its resting on standing ribs 16*a*.

Apparatus 100 preferably further includes a pair of transverse stabilizer legs 50 having a length longer than the length of sides 14 of base plate 10. Stabilizer legs 50 are configured to be attached to base plate sides 14 with a secure connection, for example with screws or similar, so that the ends 50*a* of the legs project past sides 12 of the base plate. In the illustrated example, stabilizer legs 50 have an L-shaped sectional profile, with flanges 52 and 54 set at right angles to one another. The L-shaped profile of the stabilizer legs 50 allows them to fit neatly against the flat ends 12 of base plate 10 when attaching them to the base plate.

The distance that stabilizer legs 50 extend past base plate ends 12 and sides 14 may vary, but in the illustrated example the outer ends 50*a* of the base legs are spaced from the base plate on the order of 3"-6" (inches). It would also be possible to form stabilizer legs 50 integrally with base plate 10, in whatever desired length, so that no assembly is required.

Figure 3:
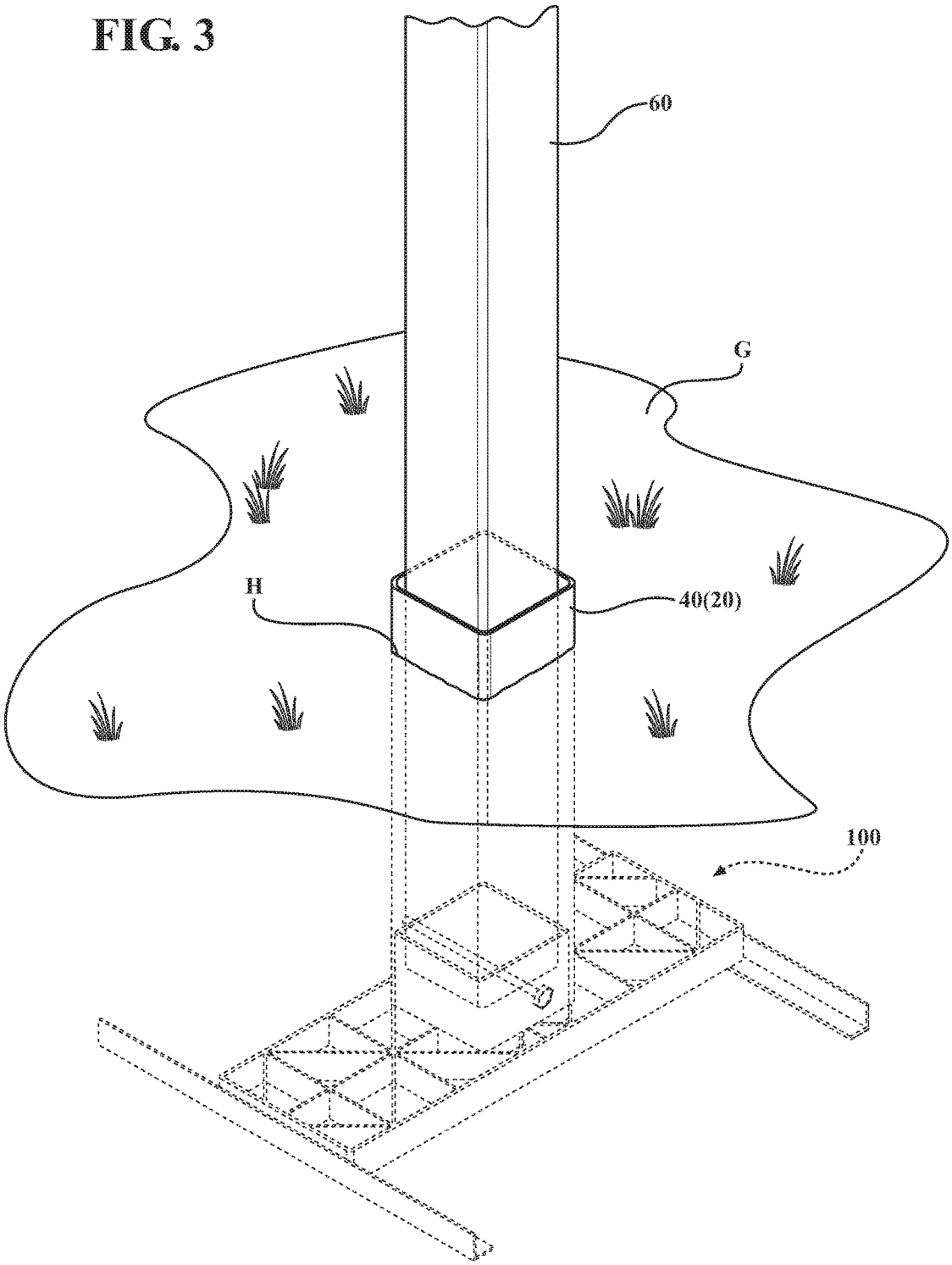
FIG. 3 is a perspective view of the assembled combination of FIG. 2, buried and with the buried portions shown in hidden lines.

Once the base plate 10, cross-piece 30, extension sleeve 40, and stabilizer legs 50 are assembled, they can be buried as a unit in a suitably sized hole H in the ground G as shown in FIG. 3. The burial depth of the base plate assembly is such that the open upper end 46 of the sleeve extension 40 remains at, or preferably above, the surface of the ground when the hole H is filled in above the base plate assembly, defining a post insertion and removal opening that will not cave in or inadvertently fill with dirt. If the socket 20 is used without a sleeve, for example where it is feasible or desirable to bury the base plate assembly at a shallow depth, or where the wall 22 of the socket is elongated to eliminate the need for a separate extension sleeve, then the upper end 26 of socket 20 is left exposed at or above ground level to define the post insertion and removal opening.

Figure 4:
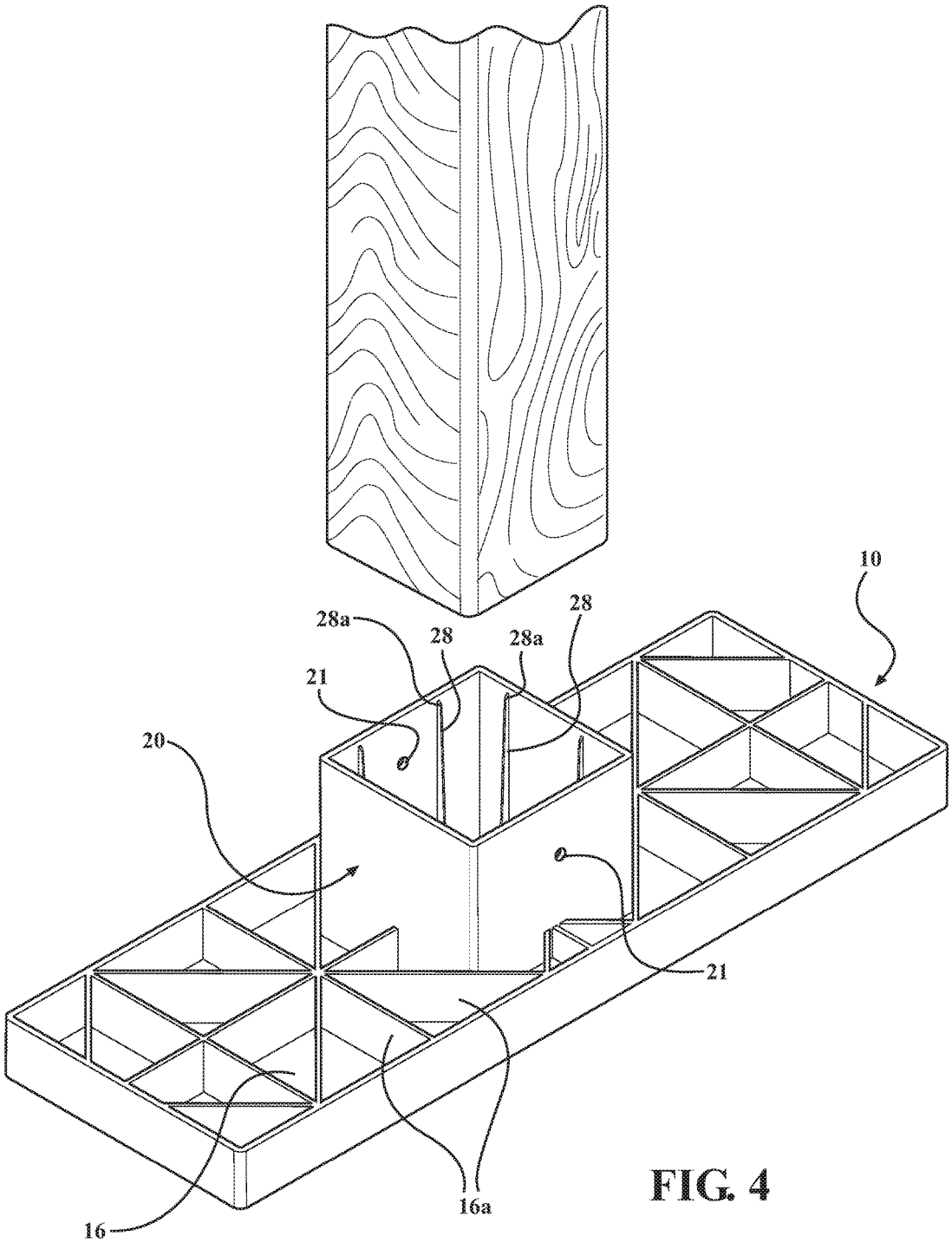
FIG. 4 is a perspective detail view of the lower end of a post exploded relative to the socket in the base plate portion of the invention.
Figure 5:
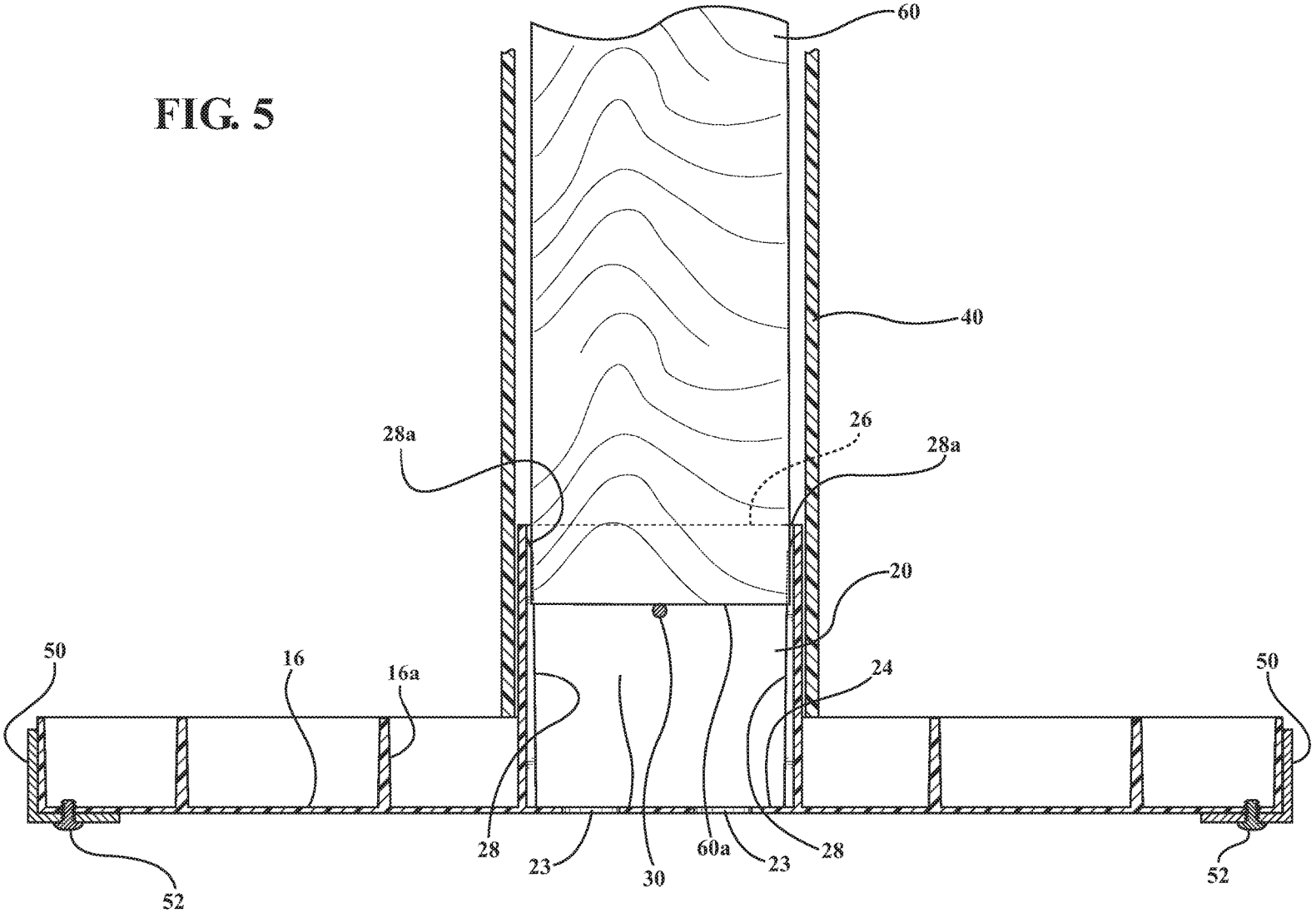
FIG. 5 is a side elevation view, in section, of the lower end detail of the structure in FIG. 4, with the post inserted in the socket and with internal portions shown in hidden lines.

Once the base plate assembly is buried as shown in FIG. 3, post 60 can simply be dropped into the open upper end 46 (or 26) of the socket formed by the socket wall/sleeve extension. As best shown in FIGS. 4 and 5, the lower end

60*a* of the post engages the upper ends 28*a* of the splines 28 over a partial length of the splines before coming to rest on cross-piece 30 spaced above the bottom 24 of the socket. This limited, partial-length engagement of the lower end of the post 60 with the upper ends 28*a* of splines 28 provides a frictional connection between the post and the socket sufficient for a snug fit (to make up for minor variations in post dimensions due to manufacturing or wear/damage to the lower end of the post), helping to stabilize the post while under load. At the same time, removal of post 60 from the buried base plate assembly remains a relatively easy task, requiring only that the post be pulled free from its engagement with the upper ends of the splines.

The spacing of the lower end 60*a* of post 60 from the bottom 24 of socket 20 helps to keep the lower end of the post clean and dry relative to any dirt or moisture finding their way into the socket during assembly, burial, or ongoing use. This protective spacing may be improved by adding one or more drain openings 23 (FIG. 5) to the bottom wall 24 of the socket 20, extending through the base plate 10 to drain directly into the ground beneath the base plate.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

What is claimed is:

1. A post mounting apparatus comprising:

a rectangular base plate comprising sides and ends and an upward-facing socket, the socket comprising a perimeter wall defining a sleeve configured to receive a lower end of a post, the socket comprising a lower end and an open upper end;

a cross-piece extending across an interior of the socket at a height between the upper and lower ends of the socket and spaced above the lower end of the socket to define a protective spacing between the lower end of the socket and the cross-piece, the cross-piece positioned to receive a lower end of a post to rest thereon spaced above the lower end of the socket, the cross-piece further having a width less than a width of the socket such that air space remains on either side of the cross-piece in the socket; and, two spaced transverse stabilizer legs, one of each of the stabilizer legs located on a respective one of the ends of the base plate parallel to the ends and perpendicular to the sides of the base plate, the stabilizer legs extending beyond their respective ends and beyond the sides of the base plate.

2. The post mounting apparatus of claim 1, wherein the socket comprises a plurality of internal vertical splines spaced around an inner side of the socket perimeter wall above the cross-piece, the splines configured to penetrate into outer end and side surfaces of a lower end of a post inserted in the socket above the cross-piece.

3. The post mounting apparatus of claim 2, wherein the splines have a length extending above and below the cross-piece so that only upper portions of the splines are available for engaging a post resting on the cross-piece.

4. The post mounting apparatus of claim 1, further comprising a sleeve extension configured to mate with the socket over an exterior of the socket perimeter wall, a lower end of the sleeve extension including apertures positioned to be aligned with apertures in the socket perimeter wall to admit the cross-piece therethrough to lock the sleeve extension to the socket.

5. The post mounting apparatus of claim 1, wherein the stabilizer legs are removably attached to the ends of the base plate.

6. A post mounting assembly comprising:

a base plate comprising an upward-facing socket, the socket comprising a perimeter wall defining a sleeve configured to receive a lower end of a post, a lower end, and an open upper end;

a cross-piece extending across an interior of the socket at a height between the upper and lower ends of the socket and spaced above the lower end of the socket to define a protective spacing in the socket between the lower end of the socket and the cross-piece; wherein, the base plate is buried below a surface of the ground with the socket facing upwardly, and wherein at least a portion of the socket including the cross-piece and the protective spacing is buried below the surface of the ground with the open upper end of the socket communicating with a post insertion and removal opening located at or above the surface of the ground, and the lower end of the post is inserted in the socket and rests on the cross-piece spaced above the lower end of the socket and above the protective spacing and below the surface of the ground;

the cross-piece having a width less than a width of the socket such that air space remains on either side of the cross-piece in the socket.

7. The post mounting assembly of claim 6, wherein the socket comprises a plurality of internal vertical splines spaced around an inner side of the socket perimeter wall above the cross-piece, the splines penetrating into outer end and side surfaces of the lower end of the post resting on the cross-piece below ground.

8. The post mounting assembly of claim 7, wherein the splines have a length extending above and below the cross-piece so that only upper portions of the splines engage the lower end of the post.

9. The post mounting assembly of claim 6, wherein the base plate is buried at a depth where the open upper end of the socket is located at or above the surface of the ground and defines the post insertion and removal opening.

10. The post mounting assembly of claim 6, further comprising a sleeve extension mated with the socket over an exterior of the socket perimeter wall, a lower end of the sleeve extension including apertures aligned with apertures in the socket perimeter wall and the cross-piece extending therethrough to lock the sleeve extension to the socket, and wherein the open upper end of the socket is below the surface of the ground and an open upper end of the sleeve extension is located at or above the surface of the ground to define the post insertion and removal opening.

11. The post mounting assembly of claim 6, wherein the base plate is rectangular and comprises ends and sides, and further comprising two spaced transverse stabilizer legs, one of each of the stabilizer legs located on a respective one of the ends of the base plate parallel to the ends and perpendicular to the sides of the base plate, the stabilizer legs extending beyond their respective ends and beyond the sides of the base plate.

12. The post mounting assembly of claim 11, wherein the stabilizer legs are removably attached to the ends of the base plate.

* * * * *